United States Patent [19]

Mamula

[11] Patent Number: 4,890,425

[45] Date of Patent: Jan. 2, 1990

[54] AIRTIGHT SUMP CROCK COVER

[75] Inventor: Ned Mamula, Aldie, Va.

[73] Assignee: Terrashield, Incorporated, Aldie, Va.

[21] Appl. No.: 215,321

[22] Filed: Jul. 5, 1988

[51] Int. Cl.[4] ..... A16J 13/02

[52] U.S. Cl. ..... 52/19; 52/169.5

[58] Field of Search ..... 137/362, 371; 52/19, 52/20, 169.5; 404/25; 248/56

[56] References Cited

U.S. PATENT DOCUMENTS

| | | | |
|---|---|---|---|
| 1,248,311 | 11/1917 | Gibson | 404/25 |
| 2,358,750 | 9/1944 | Walker et al. | 52/21 |
| 3,076,668 | 2/1963 | Famely | 248/56 |
| 3,699,730 | 10/1972 | Humphrey | 137/371 |
| 4,523,407 | 6/1985 | Miller | 404/25 |

FOREIGN PATENT DOCUMENTS

| | | | |
|---|---|---|---|
| 378599 | 3/1964 | Switzerland | 248/56 |

*Primary Examiner*—David A. Scherbel

*Assistant Examiner*—Michele A. Van Patten

*Attorney, Agent, or Firm*—Nies, Webner, Kurz & Bergert

[57] ABSTRACT

A sump crock cover for airtight istallation on the surface of a floor directly over a sump pump opening is disclosed. The cover includes a sump lid base member of generally circular shape having two spaced apart annular sealing rings which assit in preventing the escape of hazardous gases such as radon enriched soil gas. The cover has an integral radially extending ribbed section with a central aperture for the purpose of receiving a flexible grommet which provides a seal around sump discharge piping and electrical wiring. Effective O-ring sealing is obtained by positioning the O-rings radially inwardly and outwardly of the bolts which mount the cover to the floor and by providing for installation of the O-rings in grooves in the sump lid so that the O-rings extend beyond the plane of the sump lid.

6 Claims, 2 Drawing Sheets

FIG. 1
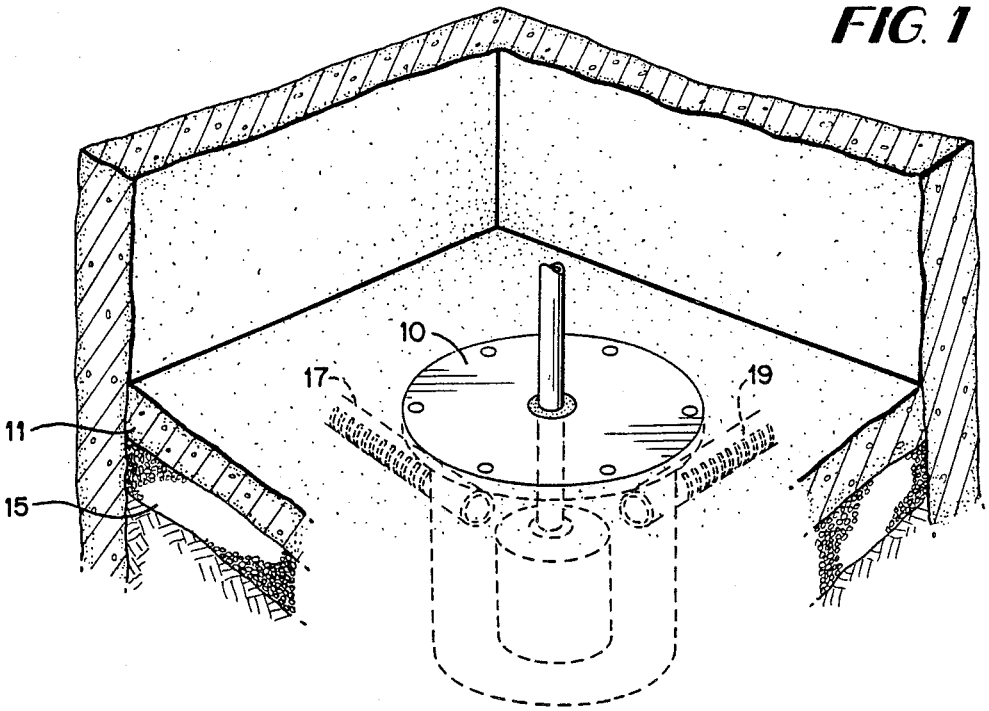
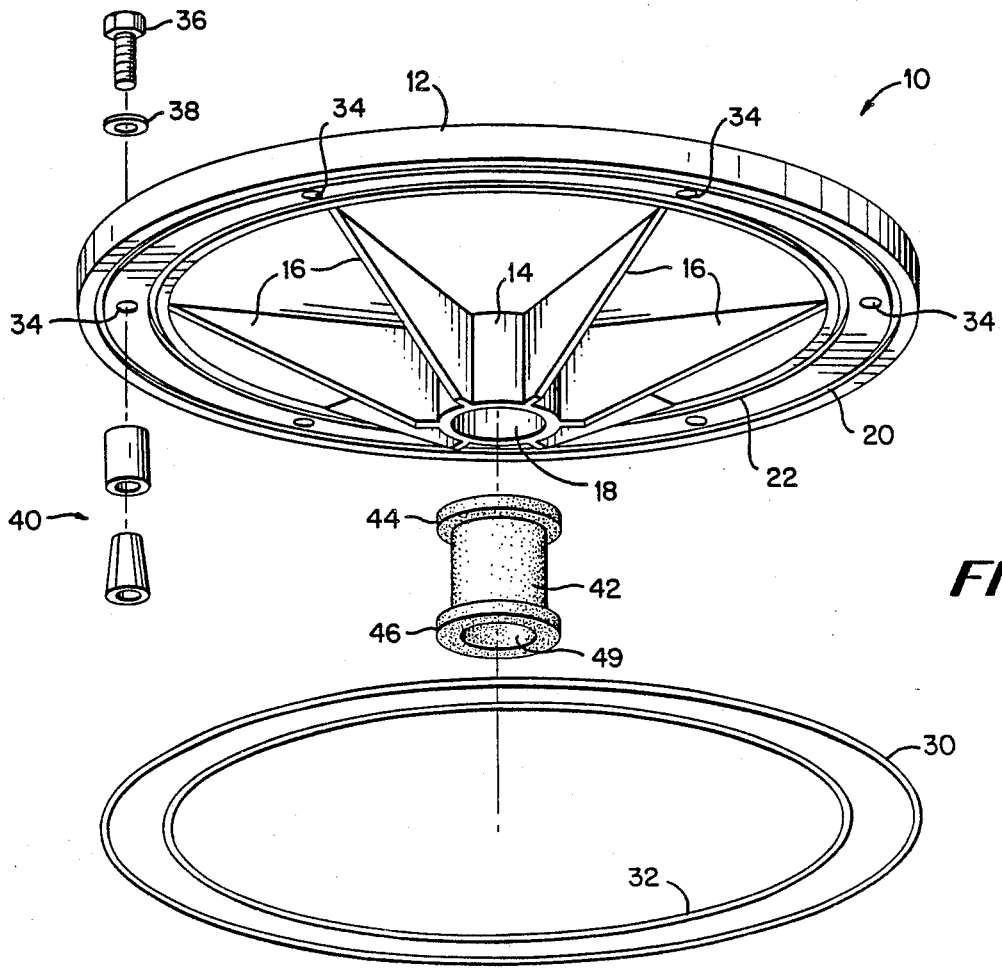
FIG. 2

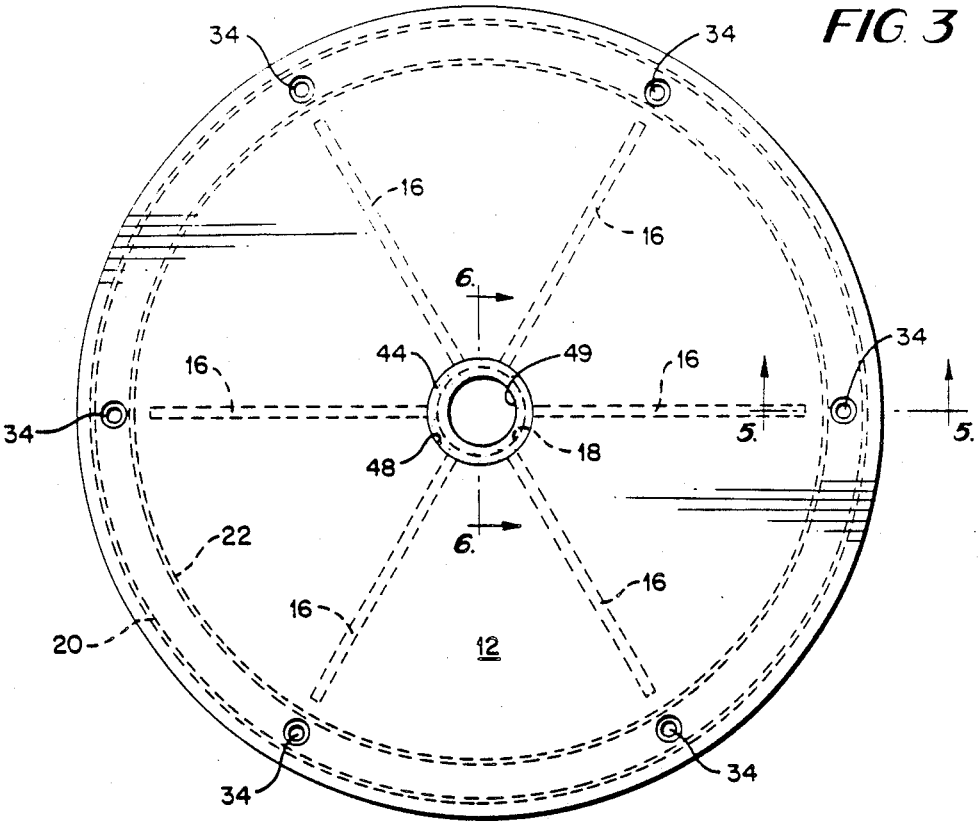
FIG. 3
FIG. 6
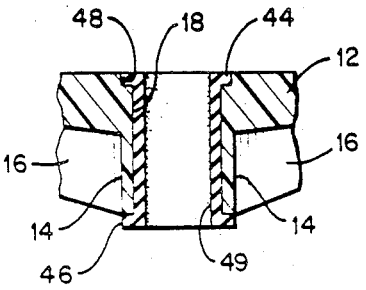
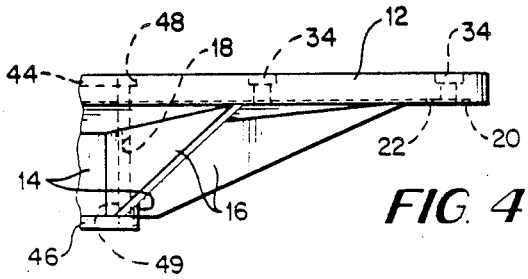
FIG. 4
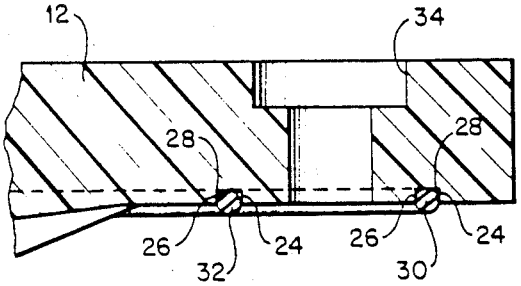
FIG. 5

AIRTIGHT SUMP CROCK COVER

BACKGROUND AND SUMMARY OF THE INVENTION

The present invention relates to a cover for a sump pump opening. More particularly, the present invention relates to a sump cover which can be bolted to the floor directly above the sump crock opening for the purpose of reducing indoor radon levels in residential and commercial buildings.

Previous covers having various types of sealing arrangements are described, for example, in the following U.S. Pats. Nos.: 2,003,770 to Goodhart; 2,358,750 to Walker et al.; 3,248,119 to Smith et al.; 4,101,236 to Meyer; 4,523,407 to Miller; and also in Canadian Patent No. 725,408 issued Jan. 11, 1966.

By the present invention, there is provided a sump crock cover for reducing radon levels in residential and commercial buildings, being well suited for installation on a basement floor directly over the sump pump opening, with the cover being of a generally circular configuration and including near its peripheral edge two spaced apart annular sealing rings which assist in preventing the escape of hazardous gases such as radon enriched soil gas. The cover includes an integral radially extending ribbed section with a central aperture therethrough for the purpose of receiving a flexible grommet which provides a seal around sump discharge piping and electrical wiring.

In one embodiment, the cover is in the form of a 22 inch diameter reinforced polyvinyl chloride (PVC) disk which is installed directly over a standard 18 inch diameter residential sump pump opening. The sump cover is constructed so that it may be bolted to the concrete slab directly above the sump crock opening. The cover does not in any way hinder normal operation of the sump pump.

The primary function of the sump crock cover of the present invention is to reduce indoor radon levels in residential and commercial buildings. This is accomplished by physically decoupling the barometric pressure gradient which exists above and below a concrete foundation slab. A pair of rubber O-rings provide an airtight seal between the sump lid and the concrete floor, while a flexible grommet provides the seal around the sump discharge piping and the electrical wiring. The cover prevents radon-enriched soil gas from being drawn from the soil beneath the slab, passing unimpeded through the sump opening, concentrating in the basement area and ultimately distributing radon throughout the entire indoor environment.

In addition to reducing the influx of soil gas radon, the sump lid has other potential benefits in residential basements or subgrade environments. These benefits include: (1) reduction of injuries and/or chance of electrical shock caused by open (uncovered) sump crocks and sump motors; (2) increase in usable floor space in the vicinity of the sump; (3) reduction of indoor odors caused by standing water or storm water discharge into the sump pit; and (4) reduction of other noxious or toxic indoor pollutants such as methane or hydrogen sulfide via soil gas influx through open sump pits.

BRIEF DESCRIPTION OF THE DRAWINGS

FIG. 1 is a perspective view showing a sump crock cover of the present invention as installed in a basement floor.

FIG. 2 is an exploded perspective view of the sump crock cover of the present invention.

FIG. 3 is a plan view of the sump crock cover of FIG. 2.

FIG. 4 is a partial side elevation of the sump crock cover of FIG. 2.

FIG. 5 is a cross sectional view taken along line 5—5 of FIG. 3.

FIG. 6 is a cross sectional view taken along line 6—6 of FIG. 3.

DESCRIPTION OF THE PREFERRED EMBODIMENTS

In the embodiment of the invention as shown in FIGS. 1 through 6, there is provided a sump crock cover 10 which includes a planar sump lid base member 12 of a generally circular shape and having a raised central portion 14 of cylindrical shape with a plurality of vertical ribs 16 extending outwardly therefrom. The ribs 16 taper towards the planar lid base member 12 outwardly of the central portion 14 of the base member 12. A central opening 18 extends through the base member 12 so as to be coaxial with the cylindrical central portion 14.

As shown in FIG. 1, the sump crock cover 10 is bolted directly to the concrete slab 11 which overlies a gravel base 15. Slotted inlet pipes 17, 19 are shown leading to and connecting with the sump crock opening 21.

In the underside of the base member 12, as shown in FIGS. 2 and 4, there are located a pair of concentric grooves 20,22 with each groove 20,22 being formed by a pair of vertical side walls 24,26 and a bottom wall 28 which define each groove 20,22 for receiving a respective O-ring gasket 30,32, as shown in detail in FIG. 5. A plurality of holes 34 are provided at intervals around the periphery of the base member 12 for the purpose of receiving bolts 36 and washers 38 which are secured in anchors 40 embedded in the floor. It has been found to be particularly advantageous to provide an O-ring seal on each side of the radius of the holes 34, resulting in excellent air-tight sealing conditions. The use of a pair of O-rings effectively overcomes sealing problems which might otherwise occur due to the following: (a) deformation of the lid upon being torqued during closure; (b) a blemish in the concrete slab; (c) shrinkage of components; and (d) a sudden lateral shearing force such as when the cover is struck by a heavy object.

A grommet 42 is provided for installation within the central opening 18 of the base member 12. The grommet 42, which may be constructed of soft molded rubber or other highly deformable and resilient material, is provided with a flange 44, 46 on each end. Flange 44 fits into recess 48 in one end of the opening 18 while flange 46 rests on the respective outer end of the central portion 14. These flanges 44, 46 assist in proper positioning of the grommet 42 within the central opening 18 upon deforming of the grommet 42 as the grommet 42 is pushed or pulled into position. The grommet 42 has an opening 49 for receiving electrical wiring and sump discharge piping.

The material of the grommet 42 should be sufficiently deformable and flexible so that it is capable of forming an airtight seal around the sump discharge piping and electrical wiring. As an example, the grommet 42 may be formed of flexible polyurethane foam. In one embodiment, the discharge piping is located concentrically within the grommet opening 49 with the electrical wiring occupying a relatively small cross sectional area adjacent the discharge piping and being held tightly by the grommet material which forms closely around the wiring. It is also within the scope of the invention to employ sleeves which are inserted inside the grommet 42 to accommodate discharge pipes of various sizes.

In one embodiment, the sump lid base member 12 had a radius of 11 inches outwardly from the center of central opening 18. The bolts 36 were positioned in holes 34 located on a circle having a radius of 10 inches and the grooves 20 and 22 were located on circles having a radius of 10 ½ inches and 9 ½ inches respectively. In this embodiment, the lid base member 12 had a thickness of ¾ inch. The central portion 14 of the base member 12 had a external diameter of 3 inches and an internal diameter of 2 ½ inches with a total height dimension through the cover 10 of 3 ¾n inches. The grommet 42 had an outside diameter of 1 ¼ inches and an inside diameter of 1 inch. The grommet flanges 44,46 had a diameter of 1 ½ inches and a thickness of ¼ inch. The size of the grommet 42 may be varied as necessary in order to achieve an airtight seal with the piping and wiring which passes through the grommet 42.

The ribs 16 had a thickness of ¼ inch in one embodiment and extended outwardly at their intersection with the lid base 12 a distance of 9 inches from the center of central opening 18. As shown, for example, in FIGS. 4 and 6, the mid portion of the lid base member 12 is somewhat raised from the main planar portion of the base member 12. Thus, in this embodiment, the distance from the external horizontal surface of the base member 12 to the intersection of the raised base portion with the central portion 14 was 1 ½ inches so that the exterior surface of the central portion 14 had a height of 2 ¼ inches.

The O-rings 30,32 may be constructed of molded rubber of ¼ inch diameter and, in one embodiment, the O-rings 30, 32 had an overall diameter of 21 and 19 inches, respectively. As shown in FIG. 5, the O-rings 30, 32 preferably protrude past the plane of the bottom of the lid 12 an amount equal to the radius of the O-ring.

The lid base member 12 with central portion 14 and ribs 16 may be constructed of any suitable material, including a plastic material such as polyvinyl chloride which may be fabricated by a suitable method such as injection molding or vacuum forming.

The bolts 36 may be any suitable construction such as ⅜ inch×2 inch hex-head (9/16 inch) high tensile strength coarse thread bolts. The washers 38 may, for example, be of ⅞ inch outside diameter and ⅜ inch inside diameter and formed of stainless steel. The anchors 40 may, for example, be ¾ inch outside diameter lead clad concrete anchors.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A sump crock cover for airtight installation on the surface of a floor directly over a sump pump opening having sump discharge piping and electrical wiring extending therefrom, said cover being capable of reducing indoor radon levels in residential and commercial buildings, comprising:

a planar sump lid base member of a generally circular shape and having a raised central portion of cylindrical shape with a plurality of vertical ribs extending outwardly therefrom, said ribs tapering toward said planar lid base member outwardly of said central portion, and with a central opening extending through said lid member so as to be coaxial with said cylindrical central portion;

said raised central portion and ribs being shaped so as to taper outwardly and downwardly to the plane of said lid member to provide a flat planar surface on the side of said lid member adjacent said raised central portion, said flat planar surface extending around the circumference of said lid outwardly of said raised central portion thereof;

a grommet member mounted within said central opening of the lid member, said grommet member being of a deformable material capable of forming an airtight seal around said piping and electrical wiring;

a pair of concentric grooves located in said flat planar surface outwardly of the raised central portion of said base member;

an O-ring gasket positioned in each groove; and bolt means for securing said base member to the floor, said bolt means including a plurality of bolts mounted around the circumference of said sump lid base member at an equidistant radius for all bolts and wherein one of said pair of concentric grooves is located radially outwardly of said radius and the other concentric groove is located radially inwardly of said radius.

2. The sump crock cover of claim 1 wherein said grommet member has a radially outwardly extending flange on each end thereof and wherein said sump lid base member has a recess or indentation for receiving each of said flanges.

3. The sump crock cover of claim 1 wherein said O-ring gaskets extend beyond the plane of said flat planar surface of the lid member by an amount equal to the radius of said O-ring gaskets.

4. A method of reducing indoor radon levels in residential and commercial buildings having a sump pump opening in a floor surface thereof, with a sump crock cover for airtight installation on the surface of the floor directly over a sump pump opening having sump discharge piping and electrical wiring extending therefrom, which comprises:

(a) securing to the floor surface surrounding said sump pump opening a sump crock cover having a planar sump lid base member of a generally circular shape and with a raised central portion of cylindrical shape having a plurality of vertical ribs extending outwardly therefrom, said ribs tapering toward said planar lid base member outwardly of said central portion, and with a central opening extending through said lid member so as to be coaxial with said cylindrical central portion; said raised central portion and ribs being shaped so as to taper outwardly and downwardly to the plane of said lid member to provide a flat planar surface on the side of said lid member adjacent said raised central portion, said flat planar surface extending around the circumference of said lid outwardly of said raised central portion thereof; a grommet member mounted within said central opening of the lid member, said grommet member being of a deformable material capable of forming an airtight seal around piping and electrical wiring; and with a pair of concentric grooves located in said flat planar surface outwardly of the raised central portion of said base member, an O-ring gasket being positioned in each groove; and a plurality of bolts for securing said base member to the floor, said bolt means including a plurality of bolts mounted around the circumference of said sump lid base member at an equidistant radius for all bolts and wherein one of said pair of concentric grooves is located radially outwardly of said radius and the other concentric groove is located radially inwardly of said radius; and (b) passing piping and wiring from said sump pump opening upwardly through said central opening within said grommet member.

5. The method of claim 4 wherein said grommet member has a radially outwardly extending flange on each end thereof and wherein said sump lid base member has a recess or indentation for receiving each of said flanges.

6. The method of claim 4 wherein said O-ring gaskets extend beyond the plane of said flat planar surface of the lid member by an amount equal to the radius of said O-ring gaskets.

* * * * *